US006447159B1

(12) United States Patent
Damasko

(10) Patent No.: US 6,447,159 B1
(45) Date of Patent: Sep. 10, 2002

(54) ACTUATION OR ADJUSTMENT MEMBER FOR WATCHES, ESPECIALLY WRISTWATCHES

(76) Inventor: Konrad Damasko, Unterhelsing 2, D-93092, Barbing (DE)

( * ) Notice: Subject to any disclaimer, the term of this patent is extended or adjusted under 35 U.S.C. 154(b) by 0 days.

(21) Appl. No.: 09/623,458

(22) PCT Filed: Feb. 24, 1999

(86) PCT No.: PCT/DE99/00489

§ 371 (c)(1),
(2), (4) Date: Oct. 20, 2000

(87) PCT Pub. No.: WO99/47984

PCT Pub. Date: Sep. 23, 1999

(30) Foreign Application Priority Data

Mar. 18, 1998 (DE) ..... 198 11 695
Jun. 27, 1998 (DE) ..... 198 28 826

(51) Int. Cl.[7] ..... G04B 37/00; G04B 29/00

(52) U.S. Cl. ..... 368/308; 368/319

(58) Field of Search ..... 368/288–290, 368/308, 319–321

(56) References Cited

U.S. PATENT DOCUMENTS 3,362,153 A * 1/1968 Wenger
5,475,750 A 12/1995 McMonagle, Jr. et al.
5,521,890 A * 5/1996 Miche ..... 238/319
5,663,934 A 9/1997 Wenger et al.

* cited by examiner

*Primary Examiner*—Vit Miska
(74) *Attorney, Agent, or Firm*—Hoffman, Wasson & Gitler, PC

(57) ABSTRACT

A novel actuating or regulating element, especially winding buttons or push-pieces, for a clock on a wristwatch, a shaft, with an actuating head provided on one end of the shaft and with a mechanism for tightly routing the shaft through one wall of the watch housing using at least one washer which concentrically surrounds the axis of the shaft.

16 Claims, 4 Drawing Sheets

ACTUATION OR ADJUSTMENT MEMBER FOR WATCHES, ESPECIALLY WRISTWATCHES

BACKGROUND OF THE INVENTION

The invention relates to an actuating or regulating element or member for watches.

Actuating elements in wristwatches are known as so-called winding buttons for setting the hands and in mechanical clocks for pulling out the clockwork. They are also known as push-pieces for starting, stopping or switching functions. These actuating elements have a shaft, which is routed through the wall of the watch housing. The end of the element which lies to the inside of the clock, interacts with the function elements of the clockwork. The end which lies to the outside of the clock is provided with, or connected to, a head which forms the actual actuating element. One major problem encountered with the element is the ability to achieve permanent pressure-tight routing of the shaft through the housing wall. Generally, washers of an elastic material are used for this purpose. The washers are deficient in that, even after a short time due to the rotary motion and the axial sliding motion of the shaft, they are subject to increased material wear, so that after a short time of operation, the penetration becomes loose and moisture, or water, can penetrate into the interior of the clock housing.

The object of the present invention is to provide an actuating, or regulating element, which avoids these defects.

SUMMARY OF THE INVENTION

In the invention, the actuating element, with the shaft and the tube, forms a complete structural unit which is mounted tightly in the watch housing. For example, this is accomplished by screwing the tube, with an external thread, into the internal thread of a hole. The actual penetration for the shaft is formed within the tube. For this purpose, in the tube, there is at least one washer which surrounds the shaft, and adjacent to the washer is at least one chamber for holding a viscous or pasty lubricant. This chamber is formed by at least one auxiliary ring.

Preferably, there is at least one chamber for holding the pasty lubricant between the two washers which follow one another in the axial direction, so that a space closed by these washers is formed, in which the chamber, which has the lubricant, is located. The lubricants can escape from the chamber, or the reserve, in the amount which is necessary for lubrication of the washers.

The chamber for the lubricant is formed by at least one auxiliary ring. The lubricant effectively prevents wear of the washers so that an almost unlimited service life, for pressure tightness of the actuating element, is achieved.

BRIEF DESCRIPTION OF THE DRAWINGS

The invention is detailed below using the following figures.

BRIEF DESCRIPTION OF THE DRAWINGS

Figure 1:
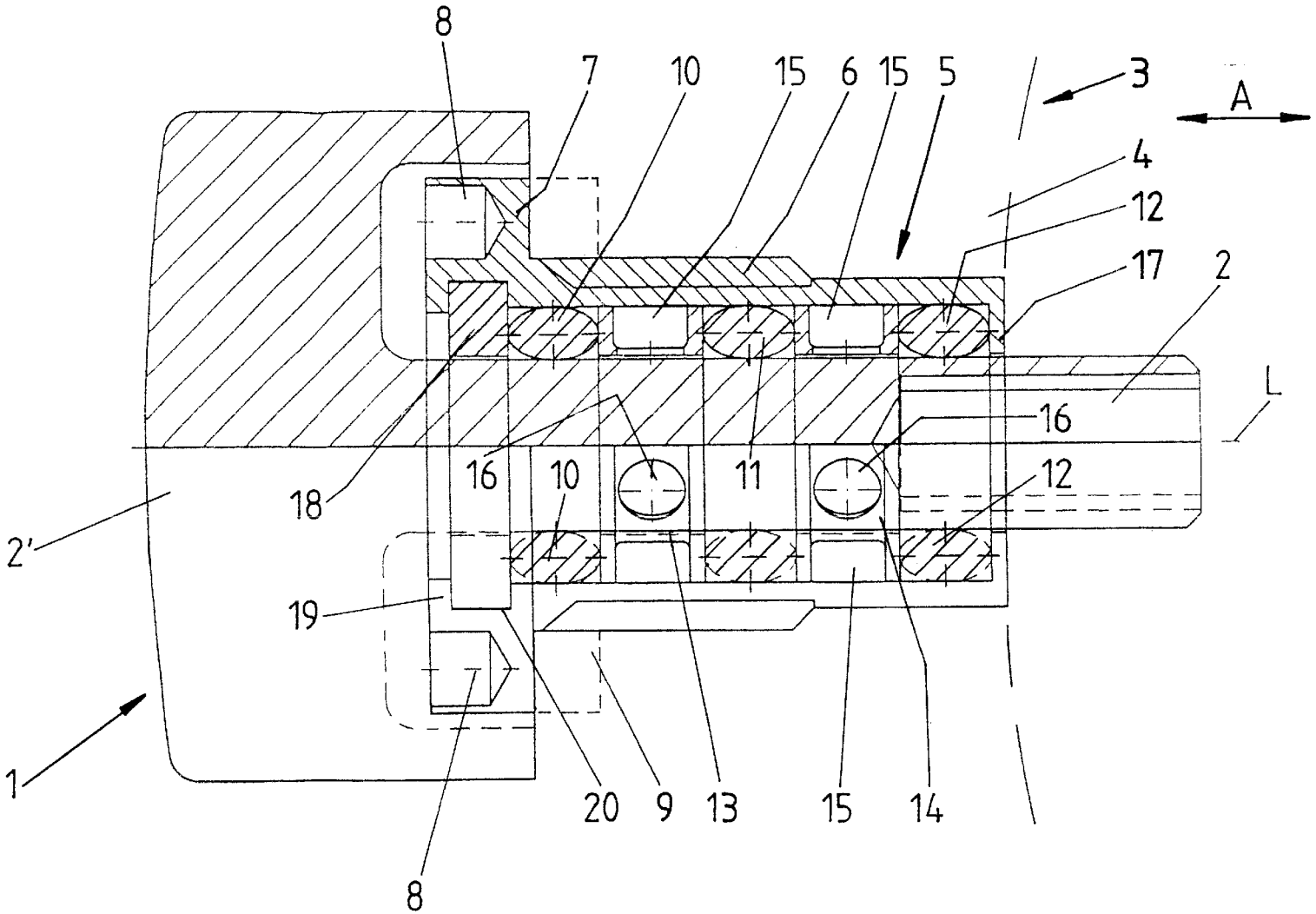
FIG. 1 shows in an enlarged representation, and in cross section, a winding button with a screw-in tube for a wristwatch.
Figure 3:
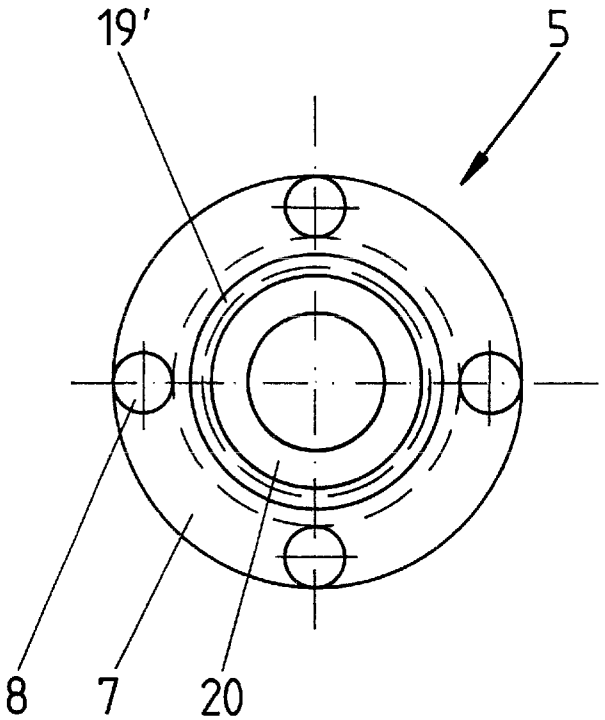
FIGS. 2 and 3 shows the tube in an individual representation in cross section and in a front view.

In the figures, the actuating element, in the form of a winding button, is labelled 1. Conventionally, it is used to set a wristwatch (which is not shown), for example, for setting the time, a date and/or for winding mechanical clockwork, etc. The winding button 1, has a shaft 2 which forms an actuating head 2' on the outside of the watch housing and which extends sealed into the interior of the watch housing 3.

The problem addressed, and solved by the invention, is to make the penetration, for the shaft 2, permanently sealed or pressure tight. The shaft, which can be turned around its axis, and at the same time can be moved axially for certain switching or setting functions by a stipulated stroke (double arrow A) must remain sealed and/or pressure tight.

To do this, a sleeve-like tube 5, with an external thread 6 provided on its outside surface, is screwed into a hole of the housing wall 4. The tube 5, has on its end, adjacent to the actuating head 2', a flange 7 which stands away over the remaining peripheral surface of the tube 5, and over the external thread 6. The flange 7, which on its front which faces the actuating head 2', and which faces away from the remaining tube 5, has several holes 8 which lie with their axis parallel to the lengthwise axis L of the tube and the shaft 2 and which are closed on the bottom. They form the working surfaces for a screw-in tool which is not shown for screwing the tube 5 into the wall 4 or into the internal thread there.

In the embodiment shown, the actuating head 2' is provided on its back with a recess which is held in the flange 7.

A washer 9, which surrounds the tube 5, and which is located between the flange 7 and one surface of the housing wall 4, ensures the necessary sealing between the tube 5 and the housing 3.

The shaft 2 extends through the tube 5 and projects with one end over the side of the tube 5 facing away from the winding button 1. The axis of the shaft 2 is coaxial with the lengthwise axis L of the tube. In the interior of the tube 5, there are three washers 10, 11 and 12. They are made of an elastic material which is suitable for seals, and are for example O-rings. Each washer 10, 11, and 12 lies with the inner annular surface directly against the circular-cylindrical surface of the shaft 2 and with the outer annular surface against a circular-cylindrical inner surface of the tube 5 at a distance from the shaft. The distance between the peripheral surface of the shaft 2 and the inner surface of the tube 5 is less than the diameter of the cross section of the washers 10–12 so that the washers 10–12 are each elastically deformed in the direction radially to the axis L, as is indicated in FIG. 1 by the oval cross section of the washers 10–12.

Between the washers 10 and 11, and between the washers 10 11 and 12, there is one auxiliary ring 13 and 14 each, against which the adjacent washers 10–12 are axially supported (in the axial direction of the lengthwise axis L). The auxiliary rings 13 and 14, which likewise surround the shaft 2, and which are located on the peripheral surface of the shaft, each have a groove 15 which is made annularly surrounding the lengthwise axis L and is open towards the periphery of the auxiliary ring 13 and 14, i.e. towards the inner surface of the tube 5. Distributed at uniform distances around the ring axis, or the lengthwise axis L, in the bottom of each groove 15 there are windows or openings 16, in the area of which the peripheral surfaces of the shaft 2 are visible. The auxiliary rings 13 and 14, or their grooves 15, are used to hold a suitable grease, for example a lithium soap-based grease, or a mineral oil-based grease, which is distributed within the tube 5 through the windows 16 onto the peripheral surface of the shaft 2 and via the open side of the respective groove 15 onto the inner surface of the tube 5, such that there is always sufficient lubrication of the washers 10–12 and of the transition of these washers to those surfaces on which there is relative motion to the respective washer 10–12 when the winding stem 1 is actuated.

Figure 2:
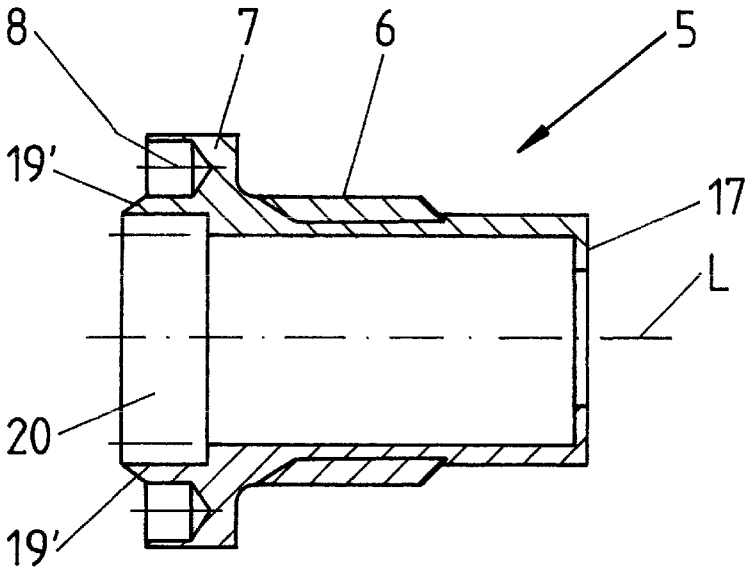

The washer 12, which is on the right in FIG. 1, is clamped between the auxiliary ring 14 and a face-side wall 17 of the tube 5, through which (wall) the shaft 2 with its one end is routed. The gasket or washer 10, which is the left one in FIG. 1, is clamped between the auxiliary ring 13 and a ring 18 which is inserted into the end of the tube 5, which has a flange 7, and is fixed there, by a beaded material section 19 which fits behind the ring 18 on the periphery. To hold the ring 18, and for accurate positioning of this ring, the interior of the tube 5 on the flange side has a cross sectional gradation 20. The beaded material section 19 is formed by producing in the manufacture or turning of the tube 5 on the flange side an annular section 19' which surrounds the opening 20 of the tube and which projects roughly over the flange side and has an outside diameter which is somewhat larger than the diameter of the section 20 (see FIG. 2). After inserting the ring 18 into the section 20, the annular section 19' is beaded so that the ring is then held in the manner shown in FIG. 1 in the tube or the section 20 there.

The described embodiment ensures pressure-tight routing of the shaft 2 through the housing wall 4 into the interior of the housing 3, which is not lost even after repeated actuation of the winding button 1 because the lubricant delivered by the auxiliary rings 13 and 14 preserves the sliding properties between the washers 10–12 and the adjacent surfaces and thus no material wear of the washers and thus leakage of the penetration occur.

Figure 4:
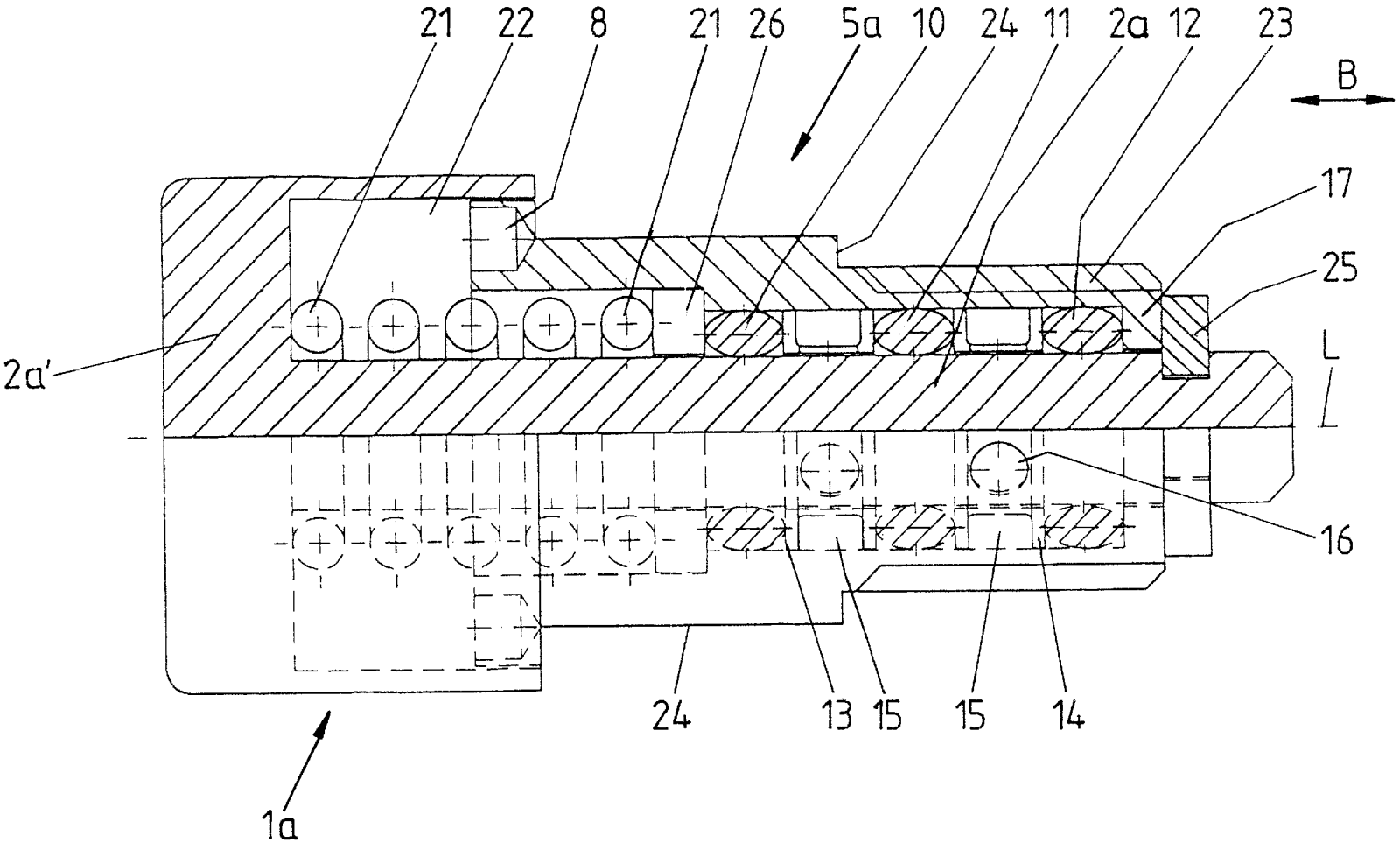
FIG. 4 shows in a representation like FIG. 1 an actuating element of a wristwatch made as a push-piece together with a tube for screwing into the housing of a wristwatch.

FIG. 4 shows in a view similar to FIG. 1 as another possible embodiment. An actuating element la is disclosed, which is made as a push-piece for a wrist watch, for example, for starting and stopping of stopwatch functions. The push-piece includes an actuating head 2*a'* with a shaft 2*a* which can be moved axially in a tube 5*a* according to the double arrow B of FIG. 4 and against the action of a compression spring 21 which surrounds the shaft 2*a* and is supported with one end against the actuating head 2*a* ' in the area of a recess 22 which the actuating head 2*a* ' has in its side facing the tube 5*a*. With a threaded section 23, the tube 5*a* can be screwed tightly into a threaded hole of the watch housing which is not shown, for example using a washer which is not shown. With the tube 5*a* screwed in, it adjoins the surface of the watch housing and has a shoulder 24 which is provided on the outer surface of the tube 5*a* adjoining the thread 23. By means of the ring 25, the shaft 22 is secured against the force of the compression spring 21 in the tube 5*a*, i.e. the ring 25 which is provided on the end of the shaft 2*a* which projects from the tube 5*a* and adjoins this end of the tube.

The compression spring 21 is supported within the tube 5*a* against a ring 26 which surrounds the shaft 2*a*. The ring 26 corresponds to the ring 18 of FIG. 1 to the extent that between the ring 26 and the end of the tube 5*a* formed by the wall 17 in the axial direction there are, following one another, the washer 10, the auxiliary ring 13, the washer 11, the auxiliary ring 17 and the washer 12. For the push-piece 1*a*, the shaft 2*a* is also routed using the tube 5*a* and the washers 10–12 there in a pressure-tight manner through the wall of the bottom housing. The lubricant is held by the auxiliary ring 13 and 14 allowing optimum lubrication of the surfaces of the washers 10–12 with almost unlimited time duration so that they cannot wear even with a plurality of actuations of the push-piece 1*a*. Leakage of the penetration of the shaft 2 is prevented.

Figure 5:
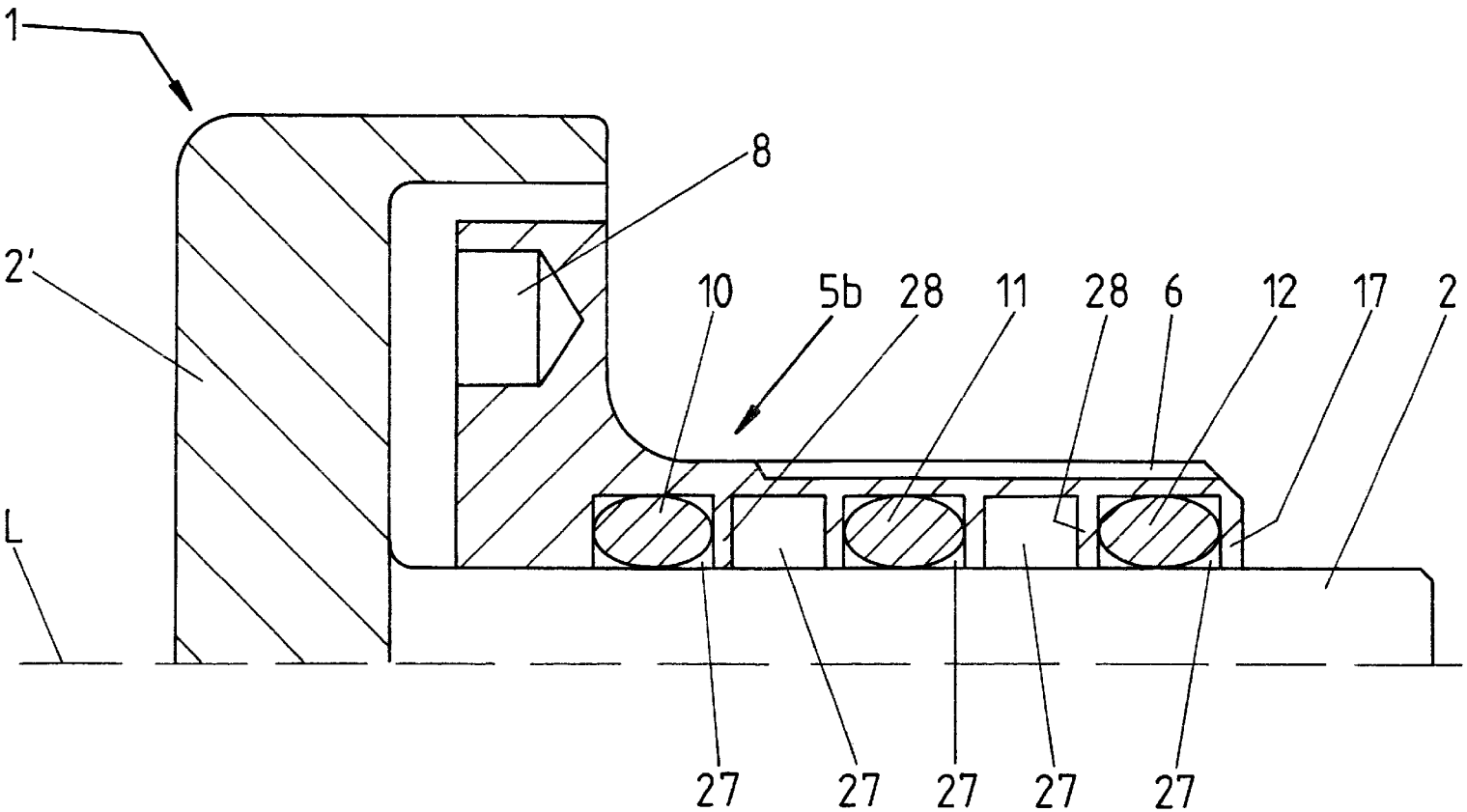
FIG. 5 shows in a simplified representation and in partial cross section an alternate embodiment of a screw-in tube for a wristwatch.

FIG. 5 shows a screw-in tube 5*b* which is made similar to the tube 5, and has on the outside an external thread 6. The tube 5*b* is used to hold the shaft 2, for example, of the winding button 1. On the inner surface of the tube, in addition to the end-face annular wall 17, in the axial direction, several annular groove notches 27 which are open towards the tube axis and which concentrically surround the tube axis offset against one another are molded and form chambers for holding the washers 10–12 and chambers for holding the viscous or pasty lubricant in between. The chambers for the washers 10–12 are each separated from the adjacent chambers for the lubricant by an annular wall section 28 which is formed by the corresponding groove notch. Like the groove notches 27, the corresponding chambers are open radially to the inside i.e. on the side adjacent to the shaft 2.

REFERENCE NUMBER LIST

1 winding button
1*a* push-piece
2, 2*a* shaft
3 watch housing
4 housing wall
5, 5*a*, 5*b* tube
6 external thread
7 flange
8 hole
9 seal
10–12 washer
13, 14 auxiliary ring
15 groove
16 window
17 wall
18 ring
19 beading
19' material section
20 gradation
21 compression spring
22 recess
23 thread
24 shoulder
25 snap ring
26 support ring
27 groove notch
28 wall section

What is claimed is:

1. An actuating element for a clock comprising:

a shaft with an actuating head on an end of the shaft and with means for tightly routing the shaft through a wall of a clock housing, means comprising at least one washer which concentrically surrounds an axis of the shaft, wherein a tube, which is anchored tightly in the watch housing, has the shaft extending therethrough, the shaft having the at least one washer sealing a gap between an inner surface of the tube and an outer surface of the shaft; and on at least a side of the at least one washer, there being provided at least one chamber holding a lubricant to limit wear at the at least one washer.

2. The actuating element as claimed in claim 1, wherein at least one chamber is formed between two washers which follow one another in an axial direction of the shaft.

3. The actuating element as claimed in claim 1, wherein at least one auxiliary ring which forms at least one chamber for accommodating the lubricant is adjacent to the at least one washer.

4. The actuating element as claimed in claim 3, wherein the at least one auxiliary rings are provided with a groove (15) which is open towards a periphery to hold the lubricant.

5. The actuating element as claimed in claim 3, wherein the at least one washer is supported axially on the at least one side on at least one auxiliary ring.

6. The actuating element as claimed in claim 1, wherein the at least one washer is supported axially on both sides on one auxiliary ring at a time.

7. The actuating element as claimed in claim 1, wherein the at least one washer is supported axially on both sides, on one side on one auxiliary ring and on an other side on a tube surface which is formed in an interior of the tube.

8. The actuating element as claimed in claim 1, wherein there are at least two washers and wherein there is at least one auxiliary ring at a time between adjacent washers.

9. The actuating element as claimed in claim 1, wherein there are at least two washers and between them there is at least one auxiliary ring and outer washers are supported on an outside, each on one tube surface.

10. The actuating element as claimed in claim 3, wherein the at least one auxiliary ring is provided on a side facing the shaft with at least one opening.

11. The actuating element as claimed in claim 1, wherein in the tube there is a support ring on which an outer washer is supported.

12. The actuating element as claimed in claim 11, wherein the support ring is fixed by beading of a material section of the tube.

13. The actuating element as claimed in claim 11, wherein the support ring is held by a reset spring or a compression spring of the actuating element.

14. The actuating element as claimed in claim 1, wherein the tube and the shaft with the actuating head are made of metal.

15. The actuating element as claimed in claim 3, wherein at least one auxiliary ring is made of metal.

16. The actuating element as claimed in claim 1, wherein the tube on an inner surface is provided with groove notches, of which at least one forms a chamber for holding the at least one washer and an adjacent groove notch forms a chamber for holding the lubricant.

* * * * *